US006998538B1

(12) United States Patent
Fetterolf, Sr. et al.

(10) Patent No.: US 6,998,538 B1
(45) Date of Patent: Feb. 14, 2006

(54) INTEGRATED POWER AND DATA INSULATED ELECTRICAL CABLE HAVING A METALLIC OUTER JACKET

(75) Inventors: James R. Fetterolf, Sr., Mechanicsburg, PA (US); Charles S. Blichasz, Boiling Springs, PA (US); William L. Donmoyer, Grantville, PA (US); Arthur H. Heuer, Cleveland Heights, OH (US); Alberto E. Planas, Sr., Miami Beach, FL (US); Alberto E. Planas, Jr., Coral Gables, FL (US)

(73) Assignee: Ulectra Corporation, North Miami Beach, FL (US)

( * ) Notice: Subject to any disclaimer, the term of this patent is extended or adjusted under 35 U.S.C. 154(b) by 0 days.

(21) Appl. No.: 10/903,756

(22) Filed: Jul. 30, 2004

(51) Int. Cl.
*H01B 11/02* (2006.01)

(52) U.S. Cl. ..... 174/113 R

(58) Field of Classification Search ..... 174/102 R, 174/113 R, 116, 120 R, 36
See application file for complete search history.

(56) References Cited

U.S. PATENT DOCUMENTS

| | | | | |
|---|---|---|---|---|
| 2,089,774 | A | | 8/1937 | Wachstein |
| 2,141,290 | A | | 12/1938 | Carlson et al. |
| 2,180,731 | A | | 11/1939 | Dickinson |
| 2,391,036 | A | | 12/1945 | Rasmussen |
| 2,583,025 | A | | 1/1952 | Swift et al. |
| 3,123,765 | A | | 3/1964 | Julie |
| 3,328,510 | A | | 6/1967 | White |
| 4,284,841 | A | | 8/1981 | Tijunelis et al. |
| 4,453,031 | A | | 6/1984 | Justiss |
| 4,506,235 | A | * | 3/1985 | Mayer ..... 333/12 |
| 4,675,474 | A | * | 6/1987 | Neuroth ..... 174/102 R |
| 4,956,523 | A | | 9/1990 | Pawluk |
| 5,085,715 | A | | 2/1992 | Tokunaga et al. |
| 5,287,074 | A | | 2/1994 | Meguro et al. |
| 5,352,301 | A | | 10/1994 | Panchanathan et al. |
| 5,371,823 | A | | 12/1994 | Barrett et al. |
| 5,414,217 | A | | 5/1995 | Neuroth et al. |
| 5,416,457 | A | | 5/1995 | Nakatsuka et al. |
| 5,427,734 | A | | 6/1995 | Yamashita et al. |
| 5,448,669 | A | | 9/1995 | Dunn et al. |
| 5,451,718 | A | | 9/1995 | Dixon |
| 6,114,632 | A | | 9/2000 | Planas, Sr. et al. |

(Continued)

OTHER PUBLICATIONS

Twenty pages downloaded from Kabelwerk Eupen AG web site having the domain name www.eupen.com. The downloaded pages describe electrical cables denoted as EMC cables. Publication date unknown. According to Kabelwerk Eupen AG, its EMC cable technology has been used in cable applications over the last 10 years.

(Continued)

*Primary Examiner*—Chau N. Nguyen
(74) *Attorney, Agent, or Firm*—Watts Hoffman Co, LPA

(57) ABSTRACT

The present invention is directed to a hybrid electrical cable providing for power transmission or distribution and data and/or voice signal communications. In one preferred embodiment, the hybrid electrical cable includes a power cable having a group of one or more high voltage power conductors for conducting power and one or more groups of low power signal conductors for transmitting voice and/or data and/or control signals. The cable further includes a power cable insulation jacket overlying the group of one or more power conductors. The power cable insulation jacket includes a soft magnetic material, preferably a soft ferrite magnetic material, for RF absorption. The cable additionally includes an outer grounded metallic jacket or sheath overlying the power cable, the power cable insulation jacket and the one or more groups of low power conductors.

22 Claims, 6 Drawing Sheets

U.S. PATENT DOCUMENTS

| | | | | |
|---|---|---|---|---|
| 6,132,635 | A | 10/2000 | Taguchi et al. | |
| 6,225,813 | B1 | 5/2001 | Garwatoski | |
| 6,369,318 | B1 | 4/2002 | Uchida et al. | |
| 2001/0040043 | A1 | 11/2001 | Ortiz et al. | |
| 2001/0042632 | A1 | 11/2001 | Manov et al. | |
| 2001/0048983 | A1 | 12/2001 | Yoshida et al. | |
| 2002/0035170 | A1 | 3/2002 | Glatkowski et al. | |
| 2002/0037054 | A1 | 3/2002 | Schurig | |
| 2002/0037376 | A1 | 3/2002 | Fenton | |
| 2003/0132022 | A1 * | 7/2003 | Williams et al. | 174/113 R |
| 2005/0001249 | A1 * | 1/2005 | Anthony et al. | 257/295 |

OTHER PUBLICATIONS

Eighteen page product catalog for EMC electrical cables manufactured by Kabelwerk Eupen AG. Product catalog was downloaded from www.eupen.com web site. Publication date unknown. However, according to Kabelwerk Eupen AG, its EMC cable technology has been used in cable applications over the last 10 years.

Pages i-viii, 1-4, and 71-101 from Raytheon owner's manual entitled *Pathfinder SL 70 Series Radar Owner's Handbook, Raytheon Marine Company* (now Raymarine Limited) (www.raymarine.com), Manchester, New Hampshire. Publication date Aug. 18, 1998. Upon information and belief, the inter-unit cable coupling the Raytheon scanner or antenna and the Raytheon radar display unit is a cable including both power conductors and data conductors in a single cable. The inter-unit cable is described on pp. 74-75.

Two page article entitled "The Risk of Unwanted EMI—How Common Mode Noise is Generated, An How to Combat It" authored by Hank Hinrichs, *Magnetics Business & Technology* magazine. Publication date Mar. 2002.

Thirty-two pages from a technical manual entitled *Permanent Magnet Guidelines*, (MMPA PMG-88) published by Magnetic Materials Producers Association, Chicago, IL 60603 (available for downloading from www.MMPA.org website). Publication date Dec. 1987.

Pages 50-108 from *Elements of Engineering Electromagnetics*, Second Edition (Chapter 2), authored by Nannapaneni Narayana Roa, Prentice Hall, Inc., Englewood Cliffs, NJ. Copyright 1987.

Two pages downloaded on Nov. 3, 2004 from Vitek Performance, Inc. web site having the domain name www.vitekperformance.com. The downloaded pages describe Vitek's marine ignition wires which purportedly include a coating of ferrite-impregnated latex. Printout of text cut-off in screen shot is provided. Publication date at least as early as Nov. 3, 2004.

Two pages downloaded on Nov. 3, 2004 from FDK Corporation web site having the domain name www.fdk.com. The downloaded pages describe FDK's USB-type interface ferrite data cables for EMI suppression. Printout of text cut-off in screen shot is provided. Publication date at least as early as Nov. 3, 2004.

* cited by examiner

| Cable Type | Transient Voltage(V) | Data Rate(Mbps) | Total Time Lost | Remarks |
|---|---|---|---|---|
| Simtra cable | 4400 | 10 | 0 | -- |
| Simtra cable | 4400 | 100 | 0 | -- |
| Simtra cable | 2500 | 100 | 0 | -- |
| Simtra cable | 3500 | 100 | 0 | -- |
| Simtra cable | 3500 | 100 | 0 | With shield connected. |
| Simtra cable | 3500 | 100 | 0 | With shield connected, but ground not driven. |
| Simtra cable | 3500 | 1000 | 100 ① | With shield connected. |
| Simtra cable | 2500 | 1000 | 100 ① | With shield connected. |
| Simtra cable | 2500 | 1000 | 0.23 | -- |
| Simtra cable | 1000 | 1000 | 0 | -- |
| Simtra cable | 500 | 1000 | 0 | -- |
| Simtra cable | 750 | 1000 | 0 | -- |
| Simtra cable | 900 | 1000 | 0 | -- |
| Simtra cable | 750 | 1000 | 0 | In grounded steel conduit. |
| Simtra cable | 1000 | 1000 | 0 | In grounded steel conduit. |
| THHN x3 | 4400 | 10 | 74 | -- |
| THHN x3 | 2500 | 10 | 2 | -- |
| THHN x3 | 4400 | 100 | 365 | -- |
| THHN x3 | 2500 | 100 | 366 | -- |
| THHN x3 | 1000 | 100 | 365 | -- |
| THHN x3 | 500 | 100 | 244 | -- |
| THHN x3 | 4400 | 1000 | 365 | -- |
| THHN x3 | 2500 | 1000 | 366 | -- |
| THHN x3 | 1000 | 1000 | 366 | -- |
| THHN x3 | 500 | 1000 | 366 | -- |
| Simtra cable | 4400 | 1000 | 365 | In grounded steel conduit. |
| Simtra cable | 4400 | 1000 | 365 | In ungrounded steel conduit. |
| NMB Cable | 4400 | 1000 | 365 | |
| NMB Cable | 2500 | 1000 | 366 | |
| NMB Cable | 1000 | 1000 | 366 | |
| NMB Cable | 500 | 1000 | 366 | |
| NMB Cable | 4400 | 100 | 364 | |
| NMB Cable | 2500 | 100 | 364 | |
| NMB Cable | 1000 | 100 | 365 | |
| NMB Cable | 500 | 100 | 182 | |
| NMB Cable | 4400 | 10 | 60 | |
| NMB Cable | 2500 | 10 | 1 | |
| NMB Cable | 1000 | 10 | 0 | |
| NMB Cable | 500 | 10 | 0 | |

①Approximate Value

Fig.9

INTEGRATED POWER AND DATA INSULATED ELECTRICAL CABLE HAVING A METALLIC OUTER JACKET

FIELD OF THE INVENTION

The present invention is directed to an insulated electrical cable and, more particularly, to an insulated electrical cable including one or more high voltage power cables and one or more groups of low power signal conductors encased in a metallic outer jacket. Each of one or more power cables of the insulated electrical cable includes a group of one or more power conductors encased in an insulation jacket including a soft magnetic material which functions to protect the integrity of signals transmitted on the one or more groups of signal conductors by absorbing radio frequency (RF) electromagnetic emissions generated by high voltage, high frequency electrical transients which may be present on one or more power conductors of the power cables due to external high frequency electrical disturbances.

BACKGROUND ART

U.S. Pat. No. 6,114,632, issued on Sep. 5, 2000 to Planas, Sr. et al. ("the '632 patent") disclosed a hybrid electrical cable. A hybrid electrical cable is an integrated, insulated electrical cable that combines both power conductors and voice/data signal conductors overlaid by an outer insulating sheath or jacket. The '632 patent hybrid cable included a first group of one or more conductors for transmitting AC power and a second group of one or more conductors for transmitting voice or data signals. Because of the proximity of the power conductors and the voice/data conductors, shielding and/or isolating the data/voice conductors from electromagnetic emissions emitted by the power conductors was of paramount concern. A first insulation sheath enclosed the first group of one or more power conductors. A second insulation sheath enclosed the second group of voice/data signal conductors.

The '632 patent disclosed that the first and second insulation sheaths included an inner layer of organic compound material and outer layer of magnetic material. The magnetic material preferably was barium ferrite. The barium ferrite layer in the first and second insulation sheaths advantageously isolated the second group of voice/data conductors from the magnetic field generated by the first group of power conductors.

The advantages of providing a single integrated cable having both power and voice/data conductors has obvious cost and installation advantages compared with utilizing two or more separate power, data and/or voice lines or cables. The '632 patent is incorporated in its entirety herein by reference.

While the hybrid cable disclosed in the '632 patent represented a significant advance over state of the art electrical cables, additional improvements were desirable, including making a cable having improved electromagnetic absorption and shielding capabilities, greater power and data capacity and being easier and less costly to manufacture.

SUMMARY OF THE INVENTION

In one preferred embodiment, a hybrid electrical cable of the present invention includes one or more power cables suitable for high voltage transmission/distribution of electrical power and one or more groups of low power signal conductors used for data, voice and/or control transmissions/ communications such as, but not limited to, twisted pairs of conductors, multi-conductor cables such as Cat5e data cable, coaxial cable, optical fiber cable ("signal conductors"). As used herein, "high voltage" means a voltage magnitude of 30 volts or more while "low power" means a power magnitude of 5 watts or less.

Each of the power cables includes a group of power conductors. For each power cable, the group of power conductors is overlaid by a power cable insulation jacket or sheath comprising a binder material and a soft magnetic material.

Optionally, the hybrid electrical cable further includes a flexible wrapping to bind together the one or more power cables and the one or more groups of signal conductors. The wrapping material may be a skip binding material fabricated from a polymer such as, for example, KEVLAR® thread or, alternatively, a polymer tape material such as, for example, MYLAR® tape.

The hybrid electrical cable additionally includes a flexible metallic outer jacket or sheath overlying the one or more power cables and the one or more groups of signal conductors. While, the hybrid electrical cable of the present invention is contemplated to be used in wiring applications where its flexibility is a necessary or desirable attribute, alternately, depending upon the application, the metallic outer jacket of the hybrid electrical cable may be rigid.

As noted above, for each of the one or more power cables, the power cable insulation jacket includes an inner layer comprising a soft magnetic material dispersed in an insulating polymer or elastomer binder material. The soft magnetic material of the power cable insulation jacket functions as a magnetic field absorber (an absorptive choke) in the radio frequency range of approximately 1 megahertz (MHz) to 400 MHz. A soft magnetic material is a material that is magnetized when introduced into a magnetic field, but retains very little of its magnetization in the absence of the magnetic field. As used herein, a "soft magnetic material" is defined as a material that has a coercivity of 1 oersted or less, when measured as a solid. Preferably, the soft magnetic material is a soft ferrite magnetic material. One suitable soft ferrite magnetic material which is commercially available is manganese zinc ferrite powder. The soft ferrite magnetic material is a high temperature dielectric and the polymer or elastomer binder is also a dielectric thereby providing a dielectric layer of resistive material between the power cable power conductors and the external environment. The polymer or elastomer binder also functions to keep the soft magnetic material together and flexible and allow the inner layer of the insulation jacket to be extruded.

The power cable insulation jacket further includes an outer insulating layer, such as polyvinyl chloride (PVC), overlying the soft magnetic material and binder material. The outer insulating layer functions as another high resistivity dielectric layer between the power cable power conductors and the external environment. The insulating layer further functions as a containment vessel for the soft magnetic material and binder material. This containment function is important in the event that the soft magnetic material and binder degrade and break apart over harsh or prolonged use.

The group of signal conductors may include one or more pairs of insulated twisted pairs of conductors, coaxial cable, optical fiber and/or other low power signal conductors known to those of skill in the art.

Preferably, the metallic outer jacket comprises a thin, flexible steel jacket. The outer metallic jacket may be spirally wound or may be fabricated of any number of metallic coverings including metal tape, metal foil, flexible metal tubing, braided wires/tapes, parallel wires/tapes and other metallic coverings known to those of skill in the art. The metallic jacket is comprised of a magnetic material or paramagnetic material (such as aluminum) and is grounded. The metallic jacket protects the group of signal conductors from externally induced electromagnetic emissions such as externally induced RF noise up to approximately 1 gigahertz (GHz).

Thus, in the hybrid cable of the present invention, the signals carried by the one or more groups of signal conductors are protected from both internally and externally generated electromagnetic emissions. The soft magnetic material overlying the power cable power conductors protects, by RF absorption, the one or more groups of signal conductors from electromagnetic emissions emitted by the power conductors due to high voltage, high frequency electrical transients imposed on one or more of the power conductors by external electrical disturbances such as lightening and other high frequency power disturbances.

Additionally, the grounded outer metallic jacket shields, by electrostatic shielding, the one or more groups of low power signal conductors from electromagnetic emissions generated by external sources in proximity to the hybrid cable. Additionally, the metallic jacket advantageously eliminates the need for metal or plastic conduit when installing the hybrid cable in a commercial or residential building, since the metallic jacket functions as its own metal conduit for building and electrical code purposes.

In one aspect of a first embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power;

b) a group of one or more low power signal conductors;

c) a power cable insulation jacket overlying the group of one or more power conductors, the power conductor insulation jacket including a soft magnetic material having a coercivity of 1 oersted or less; and d) a metallic outer jacket overlying the power cable insulation jacket and the group of one or more low power signal conductors.

In a second preferred embodiment of the hybrid cable of the present invention, the hybrid cable includes one or more high voltage power cables. Each power cable includes one or more power conductors. For each of the one or more power cables, each of the power conductors includes an insulation jacket. The power conductor insulation jacket includes an inner layer of soft magnetic material and binder material and an outer layer of insulating material such as PVC.

The hybrid cable also includes one or more groups of low power signal conductors. The hybrid electrical cable additionally includes a flexible metallic outer jacket or sheath overlying the flexible wrapping material. The flexible metallic outer jacket may be a spiral wound metal jacket.

In one aspect of a second preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power, each power conductor of the group of one or more high voltage power conductors further including a power conductor insulation jacket overlying the power conductor, the power conductor insulation jacket including a soft magnetic material having a coercivity of 1 oersted or less;

b) a group of one or more low power signal conductors; and c) a metallic outer jacket overlying the power cable and the group of one or more low power signal conductors.

In a third preferred embodiment of the hybrid cable of the present invention, the hybrid cable includes one or more high voltage power cables and one or more groups of signal conductors. Each power cable includes one or more power conductors. Each of the one or more power cables includes an insulation jacket. The power cable insulation jacket includes an inner layer of soft magnetic material and binder material and an outer layer of insulating material such as PVC.

The hybrid electrical cable additionally includes a flexible outer jacket or sheath overlying the one or more power cables and one or more groups of signal conductors. The outer jacket includes an inner layer or wrap of grounded metallic shielding. For grounding purposes, a drain wire is electrically coupled to the metal shielding, the drain wire being coupled to ground. The power cable insulation jacket further includes a middle layer of soft magnetic material and binding material which encases the metal shielding layer. The soft magnetic material of the middle layer functions as a common mode choke, converting any high frequency transients traveling along the metal shielding to heat and thereby maintaining the integrity of signals being transmitted on the one or more signal conductors. The outer jacket additionally includes an outer layer of insulating material such as PVC or polytetrafluoroethylene (PTFE) which encases the soft magnetic material/binding material layer.

In one aspect of a third preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power;

b) a group of one or more low power signal conductors; and c) a power cable insulation jacket overlying the group of one or more power conductors, the power conductor insulation jacket including an inner layer of soft magnetic material having a coercivity of 1 oersted or less; and d) an outer jacket overlying the power cable insulation jacket and the group of one or more signal conductors, the outer jacket including an inner layer of grounded metallic shielding, a middle layer of soft magnetic material having a coercivity of 1 oersted or less and an outer insulating layer.

In a fourth preferred embodiment of the hybrid cable of the present invention, the hybrid cable includes one or more high voltage power cables and one or more groups of signal conductors. Each power cable includes one or more power conductors. For each of the one or more power cables, each of the power conductors includes an insulation jacket. The power conductor insulation jacket includes an inner layer of soft magnetic material and binder material and an outer layer of insulating material such as PVC. For each power cable, a power cable insulation jacket surrounds the one or more power conductors of the cable.

The hybrid electrical cable additionally includes an outer jacket or sheath overlying and binding together the one or more power cables and the one or more groups of signal conductors. The outer jacket includes an inner layer comprising grounded metallic shielding. A drain wire, coupled to ground, is electrically coupled to the metal shielding for positive grounding of the shielding. The power cable insulation jacket further includes a layer of soft magnetic material and binding material which encases the metallic shielding. The outer jacket additionally includes an outer layer of insulating material such as PVC or PTFE which encases the soft magnetic material/binding material layer.

In one aspect of a fourth preferred embodiment of the present invention, a hybrid electrical cable provides for high voltage power transmission and/or distribution and low power signal transmission. The hybrid electrical cable includes:

a) a power cable including a group of one or more high voltage power conductors for conducting high voltage power, each power conductor of the group of one or more high voltage power conductors further including a power conductor insulation jacket overlying the power conductor, the power conductor insulation jacket including a soft magnetic material having a coercivity of 1 oersted or less;

b) a group of one or more low power signal conductors; and c) an outer jacket overlying the power cable insulation jacket and the group of one or more signal conductors, the outer jacket including an inner layer of grounded metallic shielding, a middle layer of soft magnetic material having a coercivity of 1 oersted or less, and an outer insulating layer.

These and other objects, features and advantages of the invention will become better understood from the detailed description of the preferred embodiments of the invention which are described in conjunction with the accompanying drawings.

BRIEF DESCRIPTION OF THE DRAWINGS

FIG. 9 is a listing of test results of the cut away view of an electrical fast transient test of a power cable coated with a soft magnetic material.

DETAILED DESCRIPTION

Hybrid Cable

First Preferred Embodiment

Figure 1:
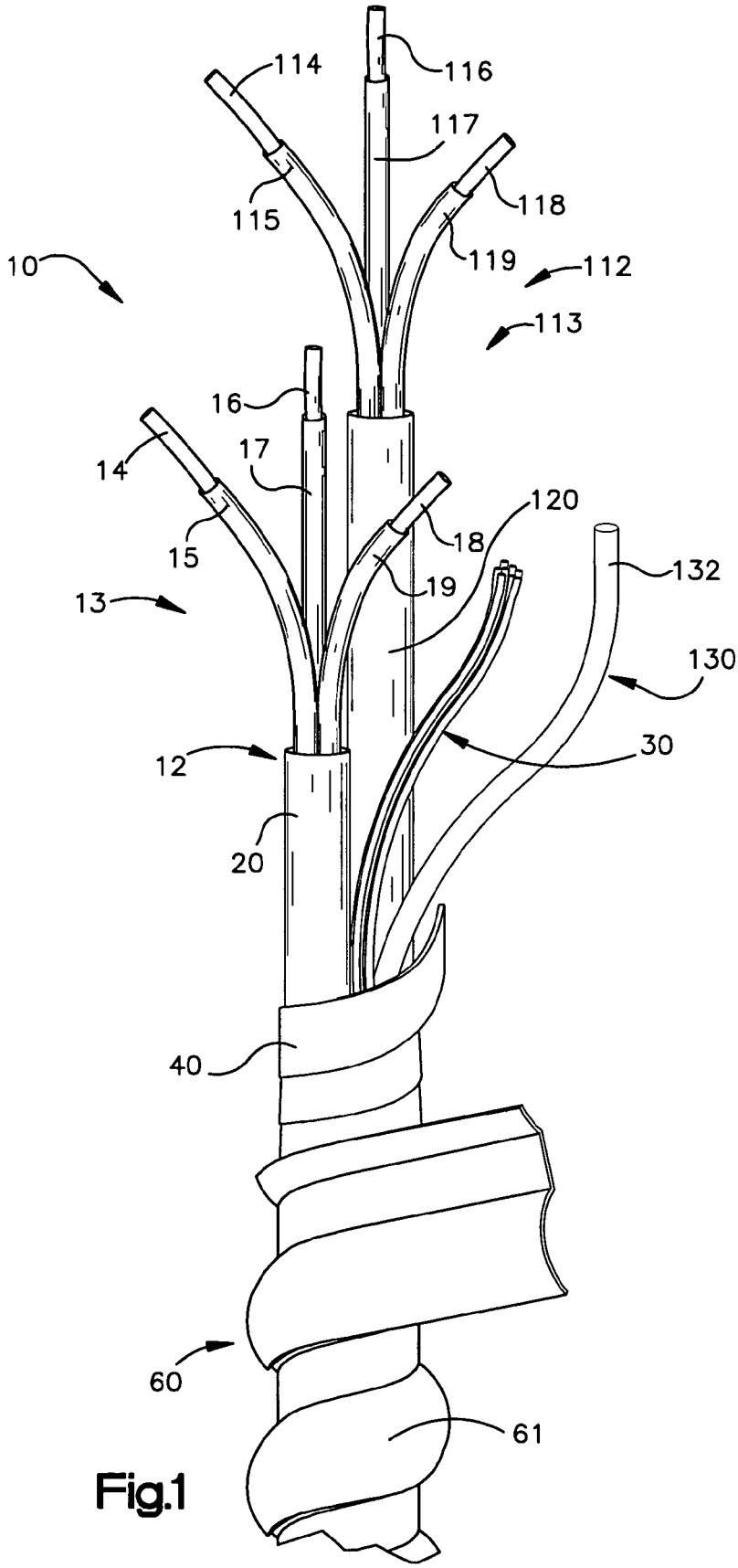
FIG. 1 is a schematic cut away view of a section of a first preferred embodiment of a hybrid electrical cable of the present invention.
Figure 2:
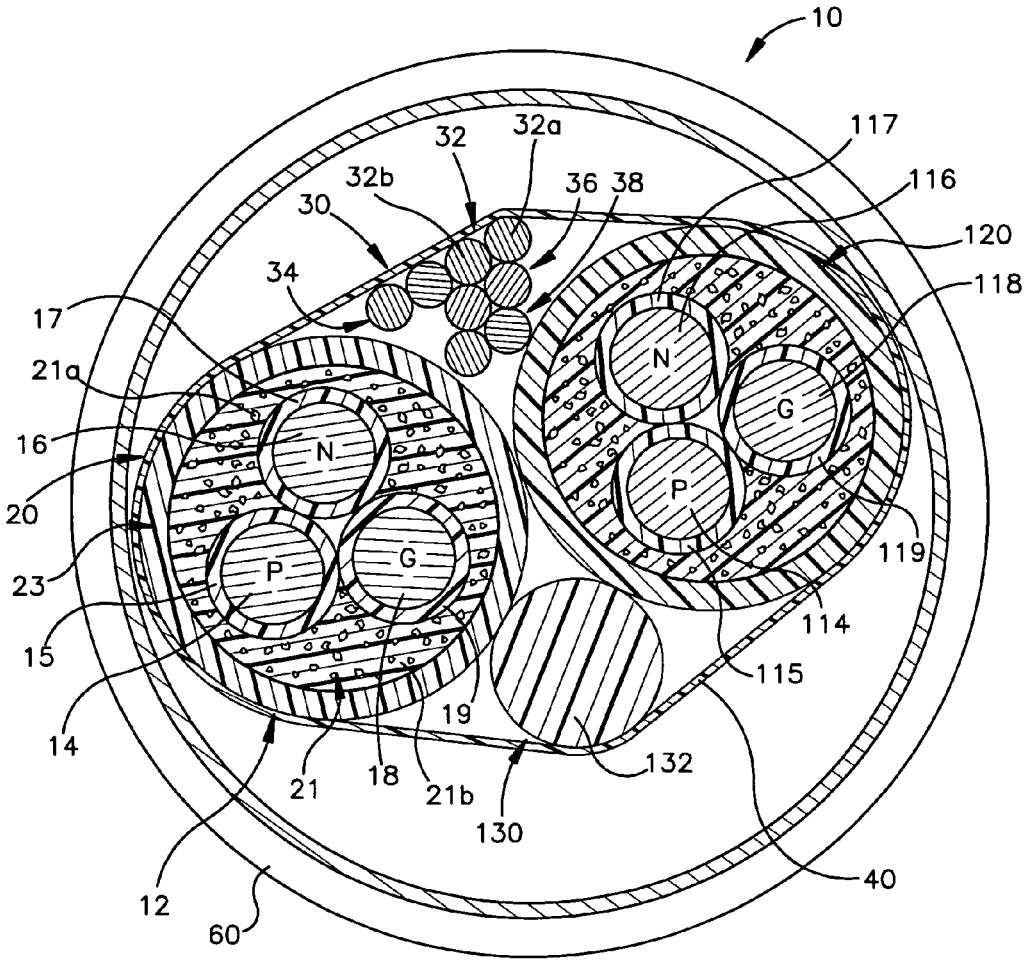
FIG. 2 is a schematic axial sectional view of the hybrid cable of FIG. 1.

A first preferred embodiment of the hybrid cable of the present invention is shown generally at 10 in FIGS. 1 and 2. The hybrid cable 10 may advantageously be employed in local and wide area computer networks where it necessary to transmit both power and multiple data/voice/control signals along parallel paths and in close proximity. However, it should be recognized that the cable 10 may be advantageously used in any electrical or electronic equipment or systems that requires power transmission and/or distribution (inside and/or outside a facility) and for communication of digital or analog signals for linking, networking or sharing/transmitting data and/or voice signals.

The data/voice/control signals being transmitted may include a variety of low power signals including data, voice, and other signals such as fire alarm, security, closed circuit TV, and further includes, without limitation, telecommunications, telephone, fax, e-mail, internet, ethernet, video, images, music, sound, light, monitoring, and control signals and other known to those of skill in the art.

One major use of the hybrid cable 10 will be providing for both high voltage power (e.g., 120V AC, 240V AC, 277V AC, 208–480V AC or 48V DC) and low power data and/or voice and/or control signal communications. As used herein, high voltage power is defined as 30 V or more (AC or DC) in accord with the National Electric Code, while low power signal communications are defined as those communications and/or transmissions involving 5 watts or less of power.

In one preferred embodiment, the hybrid cable 10 includes at least one power cable. In the particular exemplary embodiment shown in FIGS. 1–3, the hybrid cable 10 includes two power cables 12, 112. It should be recognized that the hybrid cable of the present invention may include any number (one or more) of power cables and/or power conductors. Each power cable 12, 112 includes at least one high voltage power conductor. In the exemplary embodiment shown in FIGS. 1–3, each of the two power cables 12, 112 includes a group of three power conductors 13, 113. The hybrid cable 10 also includes one or more groups of low power signal conductors (hereafter "signal conductors").

Figure 3:
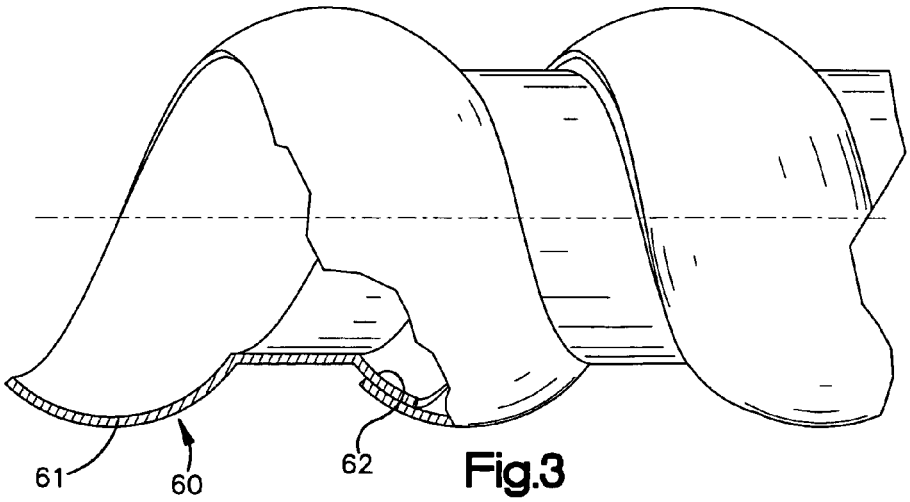
FIG. 3 is a schematic view partially in section and partially in front elevation of a metallic outer jacket or sheath of the hybrid cable of FIG. 1.

In the exemplary embodiment shown in FIGS. 1–3, there are two groups of signal conductors 30, 130. Again, it should be recognized that the hybrid cable of the present invention may include any number (one or more) of groups of signal conductors and each group may include any number (one or more) of conductors.

For each of power cables 12, 112, its respective group of power conductors 13, 113 includes one or more individually insulated copper conductors. Typically, each group of power conductors 13, 113 includes three conductors, a power conductor 14, 114, a neutral conductor 16, 116 and an isolated grounding conductor 18, 118, as is typical for 120 V AC power distribution. For three phase AC power distribution or transmission (e.g., 220–440 V three phase AC), the power conductors 14, 16, 18 and 114, 116, 118, respectively, correspond to conductors for phases A, B, C of the three phase AC power. For DC power circuits, the power conductors 14, 16, 18 and 114, 116, 118, respectively, correspond to conductors +V, −V, and ground. It should be appreciated that the conductors 14, 16, 18 and 114, 116, 118 may be solid or stranded copper conductors and that conductor materials other than copper may be used if required by an application. Further, it should be appreciated the number of power conductors may be greater than three if required by a particular application or the number of power conductors may be one or two, again depending on the specific application.

The hybrid cable 10 of the present invention contemplates use with one or more power conductors. Each of the power conductors 14, 114 includes an insulation layer 15, 115 comprising an organic compound insulating material, such as PVC, sheathed on the outside with a nylon layer or jacket. For each of the groups of power conductors 13, 113, the neutral conductor 16, 116 is insulated with an insulation layer 17, 117 comprising PVC overlaid by a nylon jacket, similar to the PVC and nylon insulation layer 15, 115 of the power carrying conductor 14, 114. For each of the groups of power conductors 13, 113, the isolated grounding conductor 18, 118 is insulated with an insulation layer 19, 119 comprising PVC overlaid by a nylon jacket, also similar to the PVC and nylon insulation layer 15, 115 of the power carrying conductor 14, 114.

For each of the power cables, 12, 112, the group of three power conductors 13, 113 is encased in an insulation jacket 20, 120. Each power cable insulation jacket 20, 120 is identical in composition and only the insulation jacket 20 of power cable 12 will be described herein. The power cable insulation jacket 20 comprises an inner or shielding layer 21 and an overlying outer layer 23. The inner layer 21 comprises a soft magnetic material 21*a* suspended in a flexible binder material 21*b*. The soft magnetic material 21*a* functions as an electromagnetic field shield in the radio frequency range of approximately 1 megahertz to 400 megahertz suspended or mixed into a binder material. A soft magnetic material is one which is magnetized when introduced into a magnetic field, but retains very little of its magnetization in the absence of the magnetic field. Preferably, the soft magnetic material 21*a* of the inner layer 21 is a soft ferrite magnetic material.

As defined herein, the soft magnetic material 21*a* is one which has a coercivity of 1 oersted or less, when measured as a solid. Coercivity (Hc) is the property of a magnetic material that is measured by the coercive force which corresponds to the saturation induction for the material. The coercive force is that value of magnetizing force required to reduce the flux density to zero (Hc). A more detailed explanation of magnetic terms, including coercivity, is provided in Chapter 2 of *Elements of Engineering Electromagnetics*, Second Edition, by Nannapaneni Narayana Roa, published by Prentice-Hall, Inc., Englewood Cliffs, N.J. (1987). The aforementioned *Elements of Engineering Electromagnetics* book is incorporated herein in its entirety by reference.

There are many suitable soft ferrite magnetic materials including, but not limited to, manganese zinc ferrite (Mn—Zn—$Fe_2O_3$). Such soft ferrite magnetic materials, including manganese zinc ferrite, are typically sold in the form magnetic components and also sold in powdered form, which is commercially from various supplies including Steward, Inc. (Steward Advanced Materials) of Chattanooga, Tenn. 37401 (www.stewardmaterials.com).

The soft magnetic material 21*a* is suspended in an elastomer or polymer binder 21*b*. One suitable polymer binder would be a thermoplastic such as polyvinyl chloride (PVC). A suitable elastomer binder would be silicon rubber. The soft ferrite magnetic material 21*a* is a high temperature dielectric and the polymer or elastomer binder 21*b* is also a dielectric thereby providing a dielectric layer of resistive material between the power cable power conductors 13 and the external environment. Manganese zinc ferrite is a brittle material which, as mentioned above, is sold in the form magnetic components and also in powdered form. The polymer or elastomer binder 21*b* also functions to encapsulate and provide flexibility of the powdered soft magnetic material 21*a*. Preferably, the inner layer 21 is an extrusible composition that is efficiently applied over the group of power conductors 13 by an extrusion process.

If it is desired to apply the inner layer 21 via extrusion and if the soft magnetic material 21*a* is obtained in powdered form, it is preferable to have a range of particle sizes of the soft magnetic material 21*a* in the extrusion mixture, up to a diameter of about 250 microns. The ratio by weight of the soft magnetic material 21*a* to the binder material 21*b* will vary with the application, the materials and the extrusion equipment. A weight ratio of 50%–50% to 70:30% is a reasonable starting point. The specific application will determine the required thickness of the soft magnetic material inner layer 21, typical thickness of the inner layer is in the range of 0.005–0.050 inch. Upon extrusion, the inner layer 21 will include small particles of soft magnetic material 21*a* randomly interspersed or distributed in the binder material 21*b*, as is shown schematically in FIG. 2.

The inner soft magnetic material layer 21 is overlaid by an outer layer or jacket 23 of an organic compound material which functions to encapsulate the inner layer 21. The outer layer 23 advantageously functions as another high resistivity dielectric layer between the power cable power conductors 13 and the external environment. The insulating layer 23 further functions as a containment vessel for the soft magnetic material and binder material layer 21. This containment function is important in the event that the soft magnetic material and binder layer 21 degrades and breaks apart over harsh or prolonged use of the cable 10. The thickness of the outer layer 23 is again dependent upon the application. A range of 0.005–0.050 inch is typical. Preferably, the organic compound material of the outer layer 23 is PVC or silicon rubber and is applied overlying the inner layer 21 by extrusion.

The soft magnetic material 21*a* overlying the power cable power conductors 14, 16, 18 protects, by RF absorption, the groups of signals conductors 30, 130 from electromagnetic emissions emitted by the power conductors due to high voltage, high frequency electrical transients imposed on one or more of the power conductors by high frequency external electrical disturbances. Stated another way, the soft magnetic material 21*a* of the inner layer 21 functions to absorb or block the magnetic field generated by the group of power conductors 13 thereby isolating the first and second groups of signal conductors 30, 130 from the power conductor electromagnetic field. This magnetic isolation of the first and second group of signal conductors 30, 130 eliminates or reduces the magnitude of any induced voltages in the first and second group of signal conductors 30, 130 resulting from the electromagnetic field, thereby reducing the probability of faulty data or analog signal transmission by the groups of signal conductors 30, 130.

The soft magnetic material 21*a* is an electrically "lossy" material which means it converts the absorbed RF energy to heat. The soft magnetic material 21*a* performs more effectively at high frequencies. When high frequency electromagnetic energy is applied to a "lossy" material like the soft magnetic material 21*a*, the magnetic domains of the material flip or reverse polarity thereby converting high frequency RF energy to heat.

The first group of signal conductors 30 includes four pair of twisted pairs of conductors. The second group of signal conductors 130 includes an optical fiber conductor 132. It should be understood that the data and frequency requirements of the system that the cable 10 is being used in connection with will dictate the number and type of conductors needed in the groups of signal conductors 30, 130. Thus, depending on system and circuit requirements, there may be more or less than four twisted pairs of conductors in each of the group of signal conductors 30. It should also be recognized that the hybrid cable 10 of the present invention may include any number of groups of signal conductors, one group, two groups, three groups, four groups, etc. Further, it should be understood that each group of signal conductors of the hybrid cable 10 may include one or more of any type of signal conductors know to those of skill in the art including twisted pair, optical fiber, coaxial cable, etc. The hybrid cable 10 of the present invention is not limited to any specific type or number of data and/or voice and/or control conductors.

The first group of signal conductors 30 includes four pair of shielded, insulated twisted pair of conductors 32 (comprising conductors 32*a*, 32*b*), 34, 36, 38 equivalent to a category 5*e* type (Cat5e) twisted pair.

Optionally, the groups of power conductors 13, 113 and the groups of signal conductors 30, 130 may be overlaid and bound together by a flexible wrapping or binding jacket 40. The wrapping functions to protect the conductors 13, 113, 30, 130 from being cut and/or abraded by a metallic outer insulation sheath 60 and further provides a marking surface upon which a product identification number and/or other required markings may be imprinted. The wrapping 40 may comprise a thin polyester tape or film, such as MYLAR®, that is spirally wrapped around the groups of power conductors 13, 113 and the groups of signal conductors 30, 130. Advantageously, the wrapping tape or film layer 40 has a thickness of between 0.0005 and 0.001 thickness and a width of ½ inch. Alternately, the wrapping jacket 40 may be a material that is wrapped around the groups of power conductors 13, 113 and signal conductors 30, 130 in a skip binding configuration.

The outer insulation sheath or jacket 60 encases the cable core, i.e., the groups of power conductors 13, 113, the groups of signal conductors 30, 130 and the wrapping or binding jacket 40. The outer sheath 60 is comprised of a grounded magnetic or paramagnetic material, such as steel or aluminum. Preferably, the outer sheath 60 comprises thin, flexible metallic jacket having a thickness of approximately 0.005 inch and a width of approximately 0.500 inch. To allow limited flexibility, the metallic sheath 60 is spirally wound. The metallic sheath 60 may also be any number of other metallic wrappings or coverings such as metal tape, metal foil, flexible metal tubing, braided wire, helically wound parallel wires/tapes and other flexible metal structures known to those of skill in the art. The metallic sheath 60 is coupled to the ground.

A cross section of the steel material that is spirally wound to fabricate the outer sheath 60 is shown in FIG. 3. Each spiral of the sheath 60 overlaps the next so that if the cable 10 is flexed, i.e., flexed to extend around a corner, no gap is created between adjacent spirals of the sheath 60. As can be seen in FIG. 3, a raised region 61 of one spiral of the sheath overlies an end region 62 of the adjacent spiral.

The metallic sheath 60 is a magnetic material and, as such, protects the group of data and/or voice conductors from externally induced electromagnet emissions such as externally induced RF noise. The metallic sheath 60 functions to "bypass" harmful AC power induced fault currents and as an eddy current RF shielding path to ground for the twisted pairs of conductors 32, 34, 36, 38. Stated another way, the grounded outer metallic jacket or sheath 60 shields, by electrostatic shielding, the groups of low power signal conductors 30, 130 from electromagnetic emissions generated by external sources in proximity to the hybrid cable 10. Additionally, the metallic jacket 60 advantageously eliminates the need for metal or plastic conduit when installing the hybrid cable in a commercial or residential building, since the metallic jacket 60 functions as its own metal conduit for building and electrical code purposes.

Additionally, the hybrid cable 10 provides significant manufacturing and inventory advantages because it allows a large number of hybrid cable configurations to be manufactured on demand in response to a customer order with the necessity of having to maintain inventory for each possible configuration of the hybrid cable. A limited number of configurations of groups of power conductors and signal conductors will be pre-manufactured and stored in inventory permitting a large number of final hybrid cable configurations to be manufactured on an as needed basis. For example, if five different configurations of power cables were manufactured and stored in inventory and five different configurations of signal conductors were manufactured and stored in inventory and the hybrid cable could be manufactured with either one or two groups of signal conductors, a customer would have the choice of 50 different configurations of hybrid cable (5 types of power conductor configurations, 5 types of signal conductor configuration, and either one or two groups of signal configurations resulting in 5×5×2=50 possible hybrid cable configurations). These 50 hybrid cable configurations would be provided with only 10 stock keeping units (groups of conductors) maintained in inventory (the five configurations of groups of power conductors and the five configurations of the groups of signal conductors).

In response to a customer orders for one of the 50 hybrid cable configurations, the appropriate pre-manufactured group of power conductors and pre-manufactured group or groups of signal conductors would be selected from inventory, threaded though an extruder and the outer insulation sheath is extruded over the groups of power and signal conductors to produce the desired hybrid cable configuration on demand for the customer.

Hybrid Cable

Second Preferred Embodiment

Figure 4:
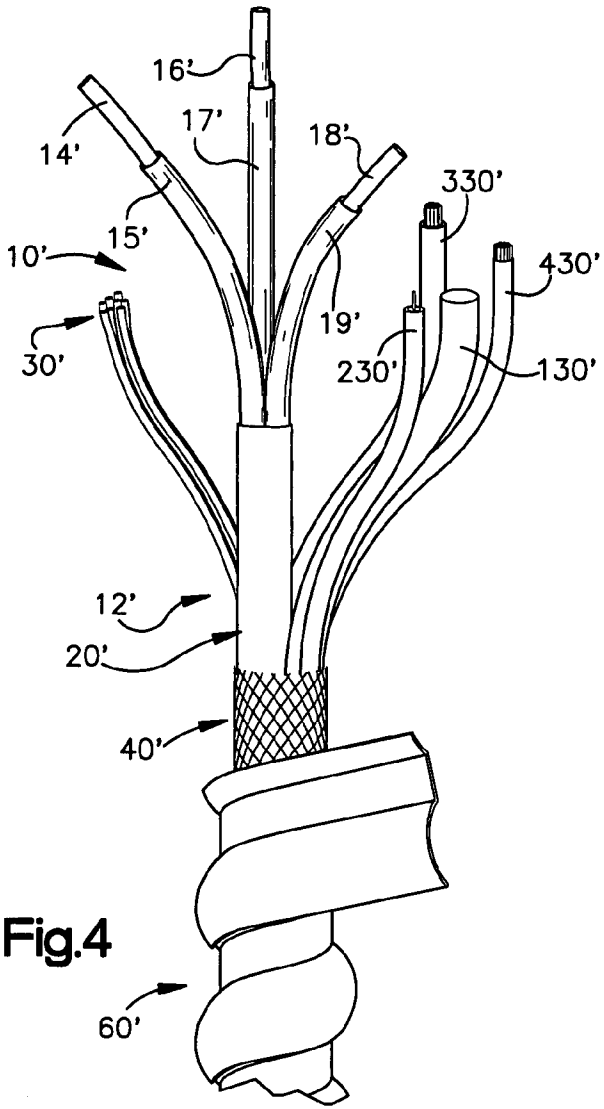
FIG. 4 is a schematic cut away view of a section of a second preferred embodiment of a hybrid electrical cable of the present invention.
Figure 5:
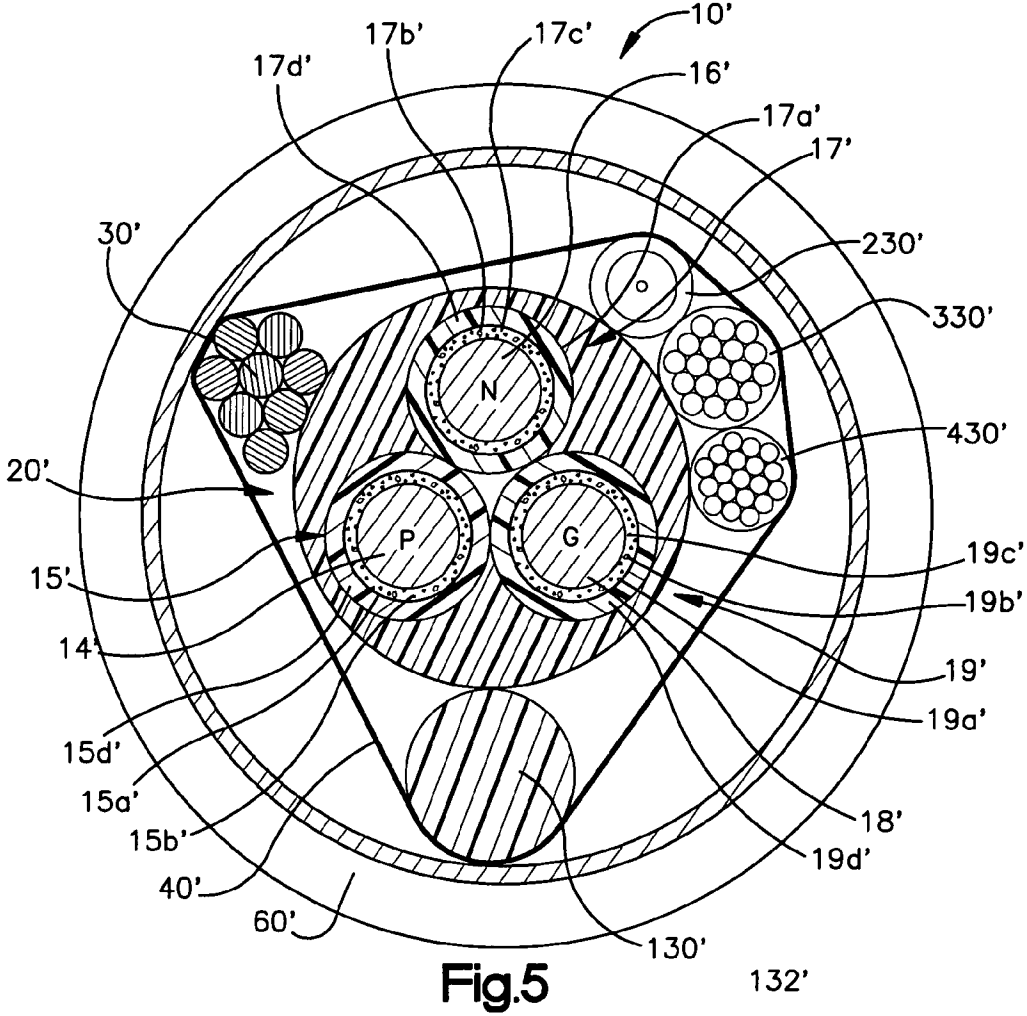
FIG. 5 is a schematic axial sectional view of a second preferred embodiment of a hybrid electrical cable of the present invention.

A second preferred embodiment of the hybrid cable of the present invention is shown generally at 10' in FIGS. 4 and 5. Fundamentally, the hybrid cable 10' of the second preferred embodiment differs from the hybrid cable 10' of the first preferred embodiment in that, in the second preferred embodiment, the soft magnetic material 15*b*', 17*b*', 19*b*' is disposed in insulation layers 15*a*'. 17*a*', 19*a*' around each of the individual power conductors 14', 16', 18' of the power cable 12'. In the first embodiment, as described above, the soft magnetic material 21*a* was disposed in a single insulation layer 21 that surrounded all three of the power conductors 14, 16, 18.

In the second embodiment, the hybrid cable 10' includes the power cable 12' comprising the group of power conductors 13'. The hybrid cable 10' also includes five groups of data/voice conductors 30', 130', 230', 330', 430'.

The group of power conductors 13' includes the power conductor 14', the neutral conductor 16' and the isolated grounding conductor 18'. The power conductors 14', 16', 18' are similar to the power conductors 14, 16, 18 described in the first embodiment. Each of the power conductors 14', 16', 18' includes a respective insulation jacket 15', 17', 19'. Each of the power conductor insulation jackets 15', 17', 19' includes an inner layer 15*a*', 17*a*', 19*a*' and an outer layer 15*d*', 17*d*', 19*d*'.

The respective inner layers 15*a*', 17*a*', 19*a*' of the insulation jackets 15', 17', 19' comprise soft magnetic material 15*b*', 17*b*', 19*b*' mixed or interspersed in a binder material 15*c*', 17*c*', 19*c*'. The soft magnetic material 15*b*', 17*b*', 19*b*' is similar to the soft magnetic material 21*a* described in the first embodiment, while the binder material 15*c*', 16*c*', 19*c*' is similar to the binder material 21*b* of the first embodiment. The outer layers 15*d*', 17*d*', 19*d*' of the insulation jackets 15', 17', 19' is an insulating material such as the material described with respect to the outer layer 23 in the first embodiment.

The insulation jackets 15', 17', 19' perform the same shielding function as the insulation jacket 20 in the first embodiment, except that the insulation jackets 15', 17', 19' individually encase the each of the power conductors 14, 16, 18 instead of surrounding the group of three power conductors 13. One advantage of having the soft magnetic material layer 15*a*', 17*a*', 19*a*' individually surrounding each of the power conductors 14, 16, 18 instead of the group of three power conductions as in the first embodiment is manufacturing efficiency. Extruder nozzles are typically circular. Since the power conductors 14', 16', 18' are circular in cross section, it is much easier and efficient for the circular extruder nozzle to apply a uniform inner layer 15*a*', 17*a*', 19*a*' of material over the circular cross section of the power conductors 14', 16', 18'. By contrast, in the first embodiment, the power conductors 14, 16, 18 form a generally triangular shape which leads to non-uniformity in the thickness of the inner soft magnetic layer 21. This non-uniformity of layer thickness can easily be seen by an examination of FIG. 2. Further, the three power conductors 14, 16, 18 do not run parallel but rather are twined or twisted around each other during the manufacturing process so that the conductors remain together during subsequent processing operations thus aggravating the non-uniformity problem or requiring that the extruder nozzle spin at the same rate of the twisting of the conductors. Also, the coating of the individual conductors 14', 16', 18' may result in more effective RF absorption in certain applications.

Overlying the power conductor insulation jackets 15', 17', 19' is an organic insulation jacket 20'. The composition of the insulation jacket 20' is similar to the composition of the outer layer 23 of the first embodiment. The hybrid cable 10' also includes the five groups of signal conductors 30', 130', 230', 330', 430'. The first group of signal conductors 30' includes four pair of twisted wire conductors. The second group of signal conductors 130' includes an optical fiber conductor. The third group of signal conductors 230' includes a coaxial cable. The forth and fifth groups of signal conductors 330', 430' include Cat5e data cables.

Optionally, a flexible wrapping or binding jacket 40', similar to the wrapping jacket 40 of the first embodiment, may be used to bind together the power cable 12' and the groups of signal conductors 30', 130', 230', 330', 430'. The wrapping jacket 40' of the second embodiment is a skip binding material fabricated from a polymer such as, for example, KEVLAR® thread. Alternately, the binding jacket 40' may comprise a polymer tape material such as, for example, MYLAR® tape.

Finally, as in the first embodiment, the hybrid electrical cable 10' additionally includes a grounded flexible metallic outer jacket or sheath 60' overlying the flexible wrapping material 40'. The flexible metallic outer jacket 60' may be spiral wound metal.

Hybrid Cable

Third Preferred Embodiment

Figure 6:
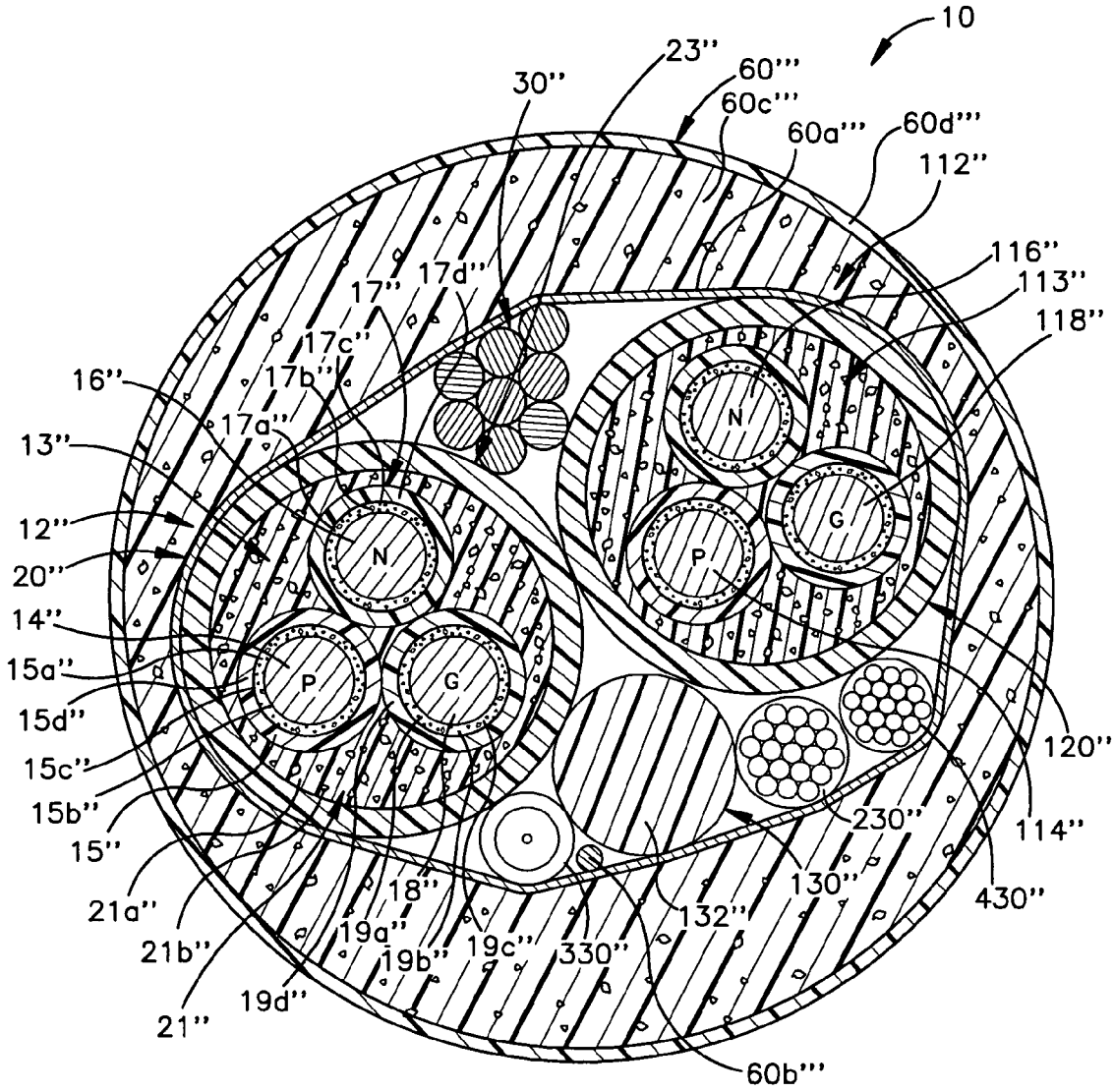
FIG. 6 is a schematic axial sectional view of a third preferred embodiment of a hybrid electrical cable of the present invention.

A third preferred embodiment of the hybrid cable of the present invention is shown generally at 10" in FIG. 6. Fundamentally, the hybrid cable 10" of the third preferred embodiment is similar to the hybrid cable 10 of the first embodiment with additions to the outer jacket 60. In the third embodiment, the hybrid cable 10" includes two power cables 12", 120" comprising respective groups of power conductors 13", 130". The hybrid cable 10" also includes five groups of signal conductors 30", 130", 230", 330", 430".

The group of power conductors 13" includes the power conductor 14", the neutral conductor 16" and the isolated grounding conductor 18". The power conductors 14", 16", 18" are similar to the power conductors 14, 16, 18 described in the first embodiment. Each of the power conductors 14", 16", 18" includes a respective insulation layer 15", 17", 19" similar to the insulation layers 15, 17, 19 of the first embodiment.

The second cable 112" includes the group of power conductors 113" comprising power conductors 114", 116", 118". The second cable 112" includes insulation layers 115", 117", 119" around each of the conductors 114", 116", 118", similar to the insulation jackets 15", 17", 19".

Additionally, as was the case in the first embodiment, the conductors of the respective power cables 12", 112" each are encased in a power cable insulation jacket 20", 120", similar to the power cable insulation jackets 20, 120 of the first embodiment. The power cable insulation jackets 20" and 120" are identical, so only the insulation jacket 20" will be described.

The power cable insulation jacket 20", like the insulation jacket 20 of the first embodiment, includes an inner layer 21" and an outer layer 23". The inner layer 21" is identical to the inner layer 21 of the first embodiment and includes a soft magnetic material 21*a*" mixed in a binder material 21*b*". The outer layer 23" is identical to the outer layer 23 of the first embodiment and comprises an organic insulating material.

The hybrid cable 10" also includes the five groups of signal conductors 30", 130", 230", 330", 430". The first group of signal conductors 30" includes four pair of twisted wire conductors. The second group of signal conductors 130" includes an optical fiber conductor. The third group of signal conductors 230" includes a coaxial cable. The forth and fifth groups of signal conductors 330", 430" include Cat5e data cables.

The hybrid electrical cable 10" additionally includes a flexible outer jacket or sheath 60" overlying the one or more power cables 12", 112" and one or more groups of signal conductors 30", 130", 230", 330", 430". The outer jacket 60" includes an inner layer 60*a*" of grounded metal shielding. The metal shielding 60*a*" is a magnetic or paramagnetic material. Preferably, the metal shielding 60*a*" is spirally wrapped around the one or more power cables and the one or more groups of signal conductors. To ground the metal shielding inner layer 60*a*", a drain wire 60*b*" is electrically coupled to the metal shielding layer 60*a*". Alternately, the drain wire 60*b*" may be eliminated if another means is used to couple the metal shielding inner layer 60*a*" to ground, for example, by crimping, soldering or welding the metal shielding 60*a*" to ground. The outer jacket 60" further includes a middle layer 60*c*" of soft magnetic material and binding material which encases the metal shielding 60*a*" and drain wire 60*b*". The middle layer 60*c*" is preferably extruded over the metal shielding layer 60*a*" and has the same composition as the power cable insulation jacket inner layer 21".

Advantageously, the soft magnetic material of the middle layer 60*c*" functions as a common mode choke, converting any high frequency transients traveling along the metal shielding 60*a*" to heat and thereby protecting the integrity of signals transmitted on the one or more groups of signal conductors 30", 130", 230", 330", 430".

The outer jacket 60" additionally includes an outer layer 60*d*" comprised of an insulating material such as PVC. The outer layer 60*d*" functions to encapsulate and contain the middle layer 60*c*". Alternately, for applications where high temperature/fire resistance is needed, such as when the cable 10" is routed through overhead air plenums in office buildings, the outer layer 60*d*" may be a PTFE based compound which has high fire resistance properties.

Hybrid Cable

Fourth Preferred Embodiment

Figure 7:
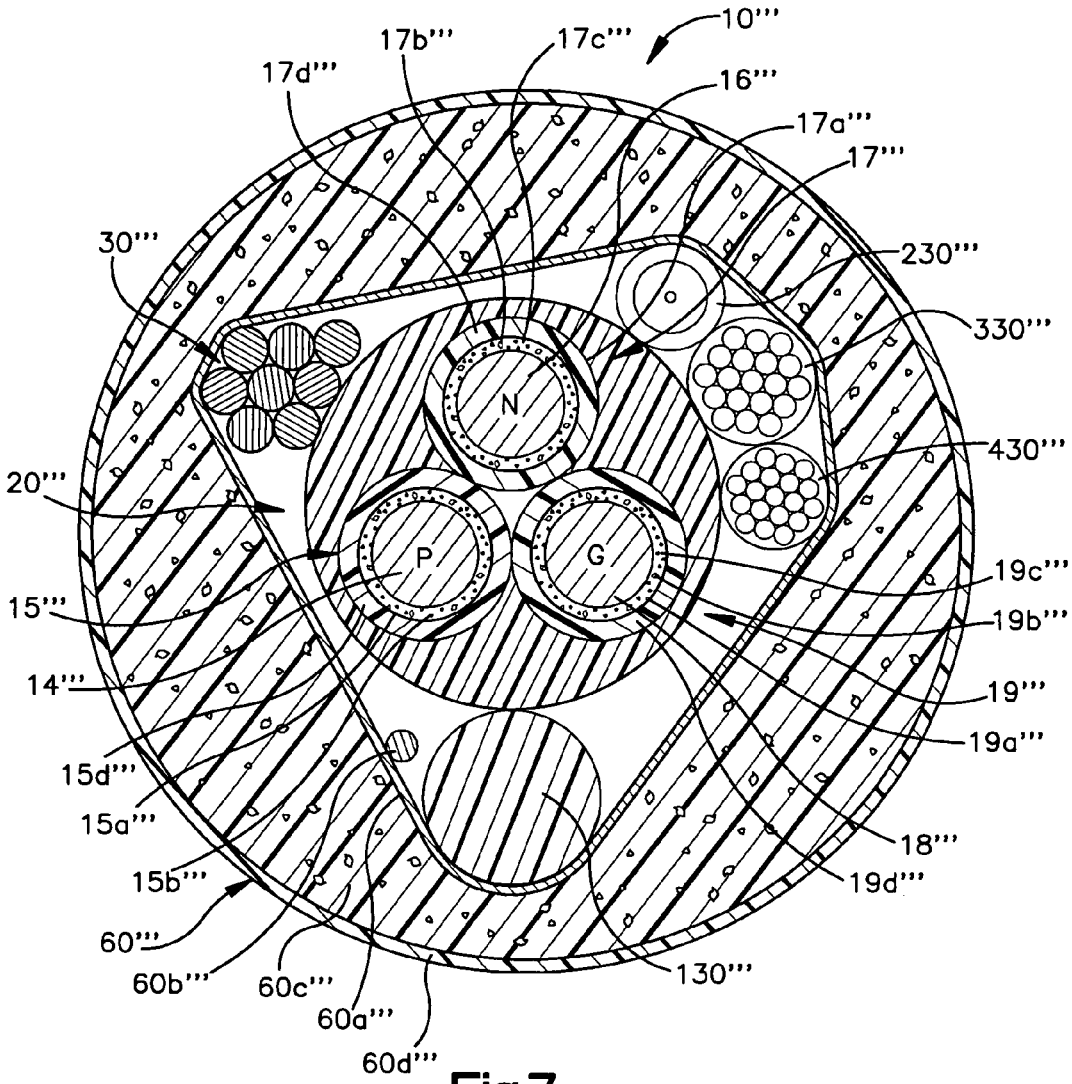
FIG. 7 is a schematic axial sectional view of a fourth preferred embodiment of a hybrid electrical cable of the present invention.

A fourth preferred embodiment of the hybrid cable of the present invention is shown generally at 10'" in FIG. 7. Fundamentally, the hybrid cable 10" of the third preferred embodiment is similar to the hybrid cable 10' of the second embodiment with additions to the outer jacket 60'. In the fourth embodiment, the hybrid cable 10" includes a power cable 12'" comprising a group of power conductors 13'". The hybrid cable 10'" also includes five groups of signal conductors 30'", 130'", 230'", 330'", 430'".

The group of power conductors 13'" includes the power conductor 14'", the neutral conductor 16'" and the isolated grounding conductor 18'". The power conductors 14'", 16'", 18'" are similar to the power conductors 14', 16', 18' described in the second embodiment. Each of the power conductors 14'", 16'", 18'" includes a respective power conductor insulation jacket 15'", 17'", 19'". Each of the power conductor insulation jackets 15'", 17'", 19'" includes an inner layer 15*a*'", 17*a*'", 19*a*'" and an outer layer 15*d*'", 17*d*'", 19*d*'".

The respective inner layers 15*a*'", 17*a*'", 19*a*'" of the power conductor insulation jackets 15'", 17'", 19'" comprise soft magnetic material 15*b*'", 17*b*'", 19*b*'" mixed or interspersed in a binder material 15*c*'", 17*c*'", 19*c*'". The soft magnetic material 15*b*'", 17*b*'", 19*b*'" is similar to the soft magnetic material 15*a*', 17*a*', 19*a*' described in the second embodiment, while the binder material 15*c*'", 17*c*'", 19*c*'" is similar to the binder material 15*c*', 17*c*', 19*c*' of the second embodiment. The outer layers 15*d*'", 17*d*'", 19*d*'" of the insulation jackets 15'", 17'", 19" are comprised of an insulating material such as the PVC material described with respect to the outer layers 15*d*', 17*d*', 19*d*' in the second embodiment.

Overlying the power conductor insulation jackets 15'", 17'", 19'" is an organic insulation jacket 20'", fabricated of PVC, nitrile rubber or other suitable insulation material. The hybrid cable 10'" also includes the five groups of signal conductors 30'", 130'", 230'", 330'", 430'". The first group of signal conductors 30'" includes four pair of twisted wire conductors. The second group of signal conductors 130'" includes an optical fiber conductor. The third group of signal conductors 230'" includes a coaxial cable. The forth and fifth groups of signal conductors 330'", 430'" include Cat5e data cables.

The hybrid electrical cable 10'" additionally includes a flexible outer jacket or sheath 60'" overlying the power cable 12'" and one or more groups of signal conductors 30'", 130'", 230'", 330'", 430'". The outer jacket 60'" includes an inner layer 60*a*'" of grounded metal shielding. The metal shielding 60*a*'" is a magnetic or paramagnetic material. Preferably, the metal shielding 60*a*'" is spirally wrapped around the power cable 12'" and the one or more groups of signal conductors 30'", 130'", 230'", 330'", 430'". To ground the metal shielding inner layer 60*a*'", a drain wire 60*b*'" may be electrically coupled to the metal shielding layer 60*a*'". Alternately, another means may be used to couple the metal shielding inner layer 60*a*'" to ground, for example, by crimping, soldering or welding the metal shielding 60'" to ground.

The outer jacket 60'" further includes a middle layer 60*c*'" of soft magnetic material and binding material which encases the metal shielding 60*a*'" and drain wire 60*b*'". The middle layer 60*c*'" is preferably extruded over the metal shielding layer 60*a*'" and has the same composition as the power conductor insulation jacket inner layers 15*a*'", 17*a*'", 19*a*'". The outer jacket 60'" additionally includes an outer layer 60*d*" comprised of an insulating material such as PVC or PTFE.

Testing of Soft Magnetic Material Surrounding a Power Cable

Empirical testing has proven the high frequency RF absorption capability of a soft magnetic material with regard to high voltage transients imposed on conductors of a power cable. Three configurations were tested. Configuration 1 was a 300 ft. length of 3AWG12 power cable which included three power conductors encased in a layer of soft magnetic material (which will be denoted as the "Simtra power cable"), skip bound with 300 ft of a Cat5E data cable. The Configuration 2 was a 300 ft. length of nonmetallic type B power cable (NMB—sold under the tradename ROMEX®), skip bound with 300 ft of a Cat5E data cable. Configuration 3 was a 300 ft. length of the THHN power cable (TWN75 FT1), skip bound with 300 ft of a Cat5E data cable.

Figure 8:
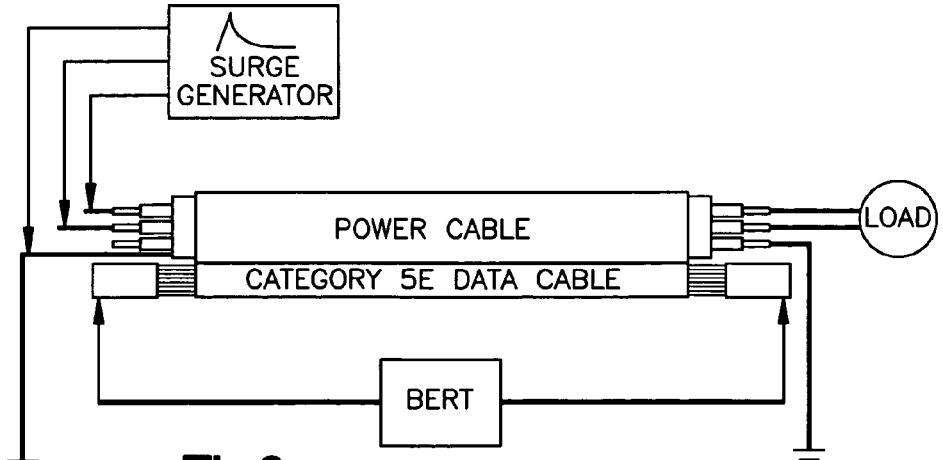
FIG. 8 is a schematic block diagram of a testing apparatus for an electrical fast transient test of a power cable coated with a soft magnetic material.

The purpose of the testing was to determine how levels of fast transients, as outlined in the standard BS EN 61000-4-4:1995, with variations in the voltage levels on the power cables affected data transmission in the Cat 5E cables. See FIG. 8 for a schematic representation of the test set up.

The Simtra, NMB and THHN power cables each were individually skip bound together with a Cat5E data cable. The data cable was terminated at a Bit Error Rate Tester (BERT) which transmitted data at 10 megabits per second (Mbps), 100 Mbps and 1000 Mbps. The power cables were energized with 120 VAC powering a 100 watt light bulb at the other end.

Electrical fast transients were induced in the power cables as outlined in the standard BS EN 61000-44:1995 with variations in the voltage levels. The BERT was monitored for errors (bit, symbol and idle) and transmission time lost (error seconds). Each test run was for seven minutes (420 second).

The electric fast transients were injected onto line, neutral and line, neutral and ground simultaneously. In each seven minute test interval, at 10 Mbs, there were 3,660,000,000 bits transmitted. At 100 Mbs, 36,600,000,000 bits were transmitted. At 1,000 MBS, 366,000,000,000 bits were transmitted.

FIG. 9 shows the test results in terms of total lost time in seconds (out of 420 seconds of data transmission time) due to data transmission errors for the various configurations at different transient voltages. If even one error was detected in a second interval, the entire second was counted as a lost time second. The remarks column shows some special configurations that were tested, where either the shield of the power cable was grounded or the whole conduit itself was grounded.

The Simtra cable exhibited little or no degradation of data transmission at all voltage levels with 10 and 100 Mbs data rates. The Simtra cable exhibited some degradation at 2500 V and 4400 V at the 1,000 Mbs data rate. The transient levels tested were representative and in excess of the environment typically found in commercial buildings. The traditional THHN and NMB cables exhibited significant degradation of data transmission at the 100 Mbs and 1000 Mbs data rates at all voltage levels.

While the present invention has been described with a degree of particularity, it is the intent that the invention includes all modifications and alterations from the disclosed embodiment falling within the spirit or scope of the appended claims.

We claim:

1. A hybrid electrical cable providing for power transmission or distribution and low power signal communications, the hybrid cable comprising:

a) a power cable including a first group of one or more conductors for conducting power;

b) a power cable insulation jacket overlying the first group of one or more power conductors, the power cable insulation jacket including a first layer comprising a soft magnetic material having a coercivity of 1 oersted or less;

c) a group of one or more low power signal conductors disposed exterior of the power cable insulation jacket; and d) an outer jacket overlying the power cable, the power cable insulation jacket and the group of one or more low power signal conductors, the outer jacket comprising a metallic material.

2. The hybrid electrical cable of claim 1 wherein the soft magnetic material of the power cable insulation jacket comprises a soft ferrite magnetic material.

3. The hybrid electrical cable of claim 2 wherein the soft ferrite magnetic material is embedded in an extrusible binder material and the power cable insulation jacket is extruded over the group of one or more power conductors to form the first layer.

4. The hybrid electrical cable of claim 3 wherein the extrusible binder material is selected from a polymer material and an elastomer material.

5. The hybrid electrical cable of claim 2 wherein the soft ferrite magnetic material of the power cable insulation jacket includes manganese zinc ferrite.

6. The hybrid electrical cable of claim 2 wherein the outer jacket additionally includes a layer overlying the metallic material, the layer comprising a soft magnetic material having a coercivity of 1 oersted or less.

7. The hybrid electrical cable of claim 1 wherein the power cable insulation jacket further includes a second organic material insulation layer overlying the first layer.

8. The hybrid electrical cable of claim 1 wherein the outer jacket metallic material comprises steel.

9. The hybrid electrical cable of claim 1 wherein the outer jacket metallic material comprises aluminum.

10. The hybrid electrical cable of claim 1 further including a binding jacket overlying the power cable insulation jacket and the group of one or more low power signal conductors to bind together the power cable and the group of one or more signal conductors, the outer jacket overlying the binding jacket.

11. The hybrid electrical cable of claim 1 wherein the group of one or more low power signal conductors is disposed exterior of the power cable.

12. A hybrid electrical cable for high voltage power transmission or distribution and low power signal transmission, the hybrid electrical cable comprises:

a) a power cable including a group of one or more high voltage power conductors for conducting high voltage power;

b) the power cable further including a power cable insulation jacket overlying the group of one or more power conductors, the power cable insulation jacket having a first layer including a soft magnetic material having a coercivity of 1 oersted or less;

c) a group of one or more low power signal conductors disposed exterior of the power cable insulation jacket; and d) a grounded metallic outer jacket overlying the power cable, the power cable insulation jacket and the group of one or more low power signal conductors.

13. The hybrid electrical cable of claim 12 wherein the soft magnetic material of the power cable insulation jacket comprises a soft ferrite magnetic material.

14. The hybrid electrical cable of claim 13 wherein the soft ferrite magnetic material is embedded in an extrusible binder material and the power cable insulation jacket is extruded over the group of one or more power conductors to form the first layer.

15. The hybrid electrical cable of claim 14 wherein the extrusible binder material is selected from a polymer material and an elastomer material.

16. The hybrid electrical cable of claim 13 wherein the soft ferrite magnetic material of the power cable insulation jacket includes manganese zinc ferrite.

17. The hybrid electrical cable of claim 13 wherein the outer jacket includes a layer of soft magnetic material overlying the metallic material, the soft magnetic material having a coercivity of 1 oersted or less.

18. The hybrid electrical cable of claim 12 wherein the power conductor insulation jacket further includes a second organic material insulation layer overlying the first layer.

19. The hybrid electrical cable of claim 12 wherein the outer jacket metallic material comprises steel.

20. The hybrid electrical cable of claim 12 wherein the outer jacket metallic material comprises aluminum.

21. The hybrid electrical cable of claim 12 further including a binding jacket overlying the power cable insulation jacket and the group of one or more lower power signal conductors to bind together the power cable and the group of one or more signal conductors, the outer jacket overlying the binding jacket.

22. A hybrid electrical cable providing for power transmission or distribution and low power signal communications, the hybrid cable comprising:

a) a power cable including a first group of one or more conductors for conducting power;

b) a power cable insulation jacket overlying the first group of one or more power conductors, the power cable insulation jacket including a first layer comprising a soft magnetic material having a coercivity of 1 oersted or less;

c) a group of one or more low power signal conductors disposed exterior to the power cable; and d) an outer jacket overlying the power cable, the power cable insulation jacket and the group of one or more low power signal conductors, the outer jacket comprising a metallic material.

* * * * *